US007469681B2

(12) United States Patent
Hataura et al.

(10) Patent No.: US 7,469,681 B2
(45) Date of Patent: Dec. 30, 2008

(54) MULTI-CYLINDER ENGINE

(75) Inventors: Kiyoshi Hataura, Sakai (JP); Manabu Miyazaki, Sakai (JP); Toshinori Okajima, Fuji (JP); Osamu Takii, Sakai (JP); Mitsuru Kamiyama, Sakai (JP); Mutsumi Murata, Sakai (JP); Hiroshi Mikumo, Sakai (JP); Yasushi Nakamura, Sakai (JP)

(73) Assignee: Kubota Corporation, Osaka (JP)

( * ) Notice: Subject to any disclaimer, the term of this patent is extended or adjusted under 35 U.S.C. 154(b) by 0 days.

(21) Appl. No.: 11/531,756

(22) Filed: Sep. 14, 2006

(65) Prior Publication Data

US 2007/0068492 A1 Mar. 29, 2007

(30) Foreign Application Priority Data

Sep. 28, 2005 (JP) ..... P 2005-281755

(51) Int. Cl.
*F02M 69/46* (2006.01)
*F02M 55/02* (2006.01)
*F02M 35/10* (2006.01)

(52) U.S. Cl. ..... 123/456; 123/184.38

(58) Field of Classification Search ..... 123/456, 123/468, 469, 193.5, 184.21, 184.38
See application file for complete search history.

(56) References Cited

U.S. PATENT DOCUMENTS 4,516,555 A * 5/1985 Shioya et al. ..... 123/470
4,570,602 A * 2/1986 Atkins et al. ..... 123/468
4,601,275 A * 7/1986 Weinand ..... 123/468
4,702,202 A * 10/1987 Hensel et al. ..... 123/184.24
4,966,120 A * 10/1990 Itoh et al. ..... 123/516
5,009,212 A * 4/1991 Bishai ..... 123/533
5,074,269 A * 12/1991 Herbon et al. ..... 123/470
5,309,885 A * 5/1994 Rawlings et al. ..... 123/509
5,357,931 A * 10/1994 Semence ..... 123/456
5,465,699 A * 11/1995 Voigt ..... 123/470
5,927,254 A 7/1999 Ino et al.
6,691,673 B2 * 2/2004 Katayama ..... 123/305

(Continued)

FOREIGN PATENT DOCUMENTS

JP 2001-227407 A 8/2001

(Continued)

*Primary Examiner*—Thomas N Moulis
(74) *Attorney, Agent, or Firm*—Panitch Schwarze Belisario & Nadel LLP

(57) ABSTRACT

A multi-cylinder engine wherein a direction in which a crank shaft spans is a front and rear direction and a widthwise direction of a cylinder head (1) perpendicular to the front and rear direction is a lateral direction, the multi-cylinder engine comprising the cylinder head (1) which has one lateral side to which an intake-air distributing passage wall (2) and has the other lateral side to which an exhaust-gas converging passage wall (3), a common rail (10) being arranged around the cylinder head (1). In this multi-cylinder engine, the common rail (10) is arranged immediately lateral of the intake-air distributing passage wall (2), thereby positioning the intake-air distributing passage wall (2) between the cylinder head (1) and the common rail (10). Preferably, an intake-air inlet pipe (11) is made to stand up at an upper portion of the intake-air distributing passage wall (2) and is provided with an intake-air flange portion (12), which is positioned just above the common rail (10).

12 Claims, 4 Drawing Sheets

U.S. PATENT DOCUMENTS

| | | | | |
|---|---|---|---|---|
| 6,752,114 | B2 * | 6/2004 | Ochiai et al. | 123/184.21 |
| 6,758,192 | B2 * | 7/2004 | Vanderveen et al. | 123/456 |
| 2001/0025627 | A1 * | 10/2001 | Lamb et al. | 123/456 |

FOREIGN PATENT DOCUMENTS

| | | | |
|---|---|---|---|
| JP | 2004-324515 | A | 11/2004 |
| WO | 00/42314 | A1 | 7/2000 |

* cited by examiner

MULTI-CYLINDER ENGINE

BACKGROUND OF THE INVENTION

The present invention concerns a multi-cylinder engine and more particularly, relates to a multi-cylinder engine able to inhibit a common rail from being damaged.

There is a conventional example of the multi-cylinder engine which comprises a cylinder head having one lateral side surface onto which an intake-air distributing passage wall is attached and having the other lateral side surface onto which an exhaust-gas converging passage wall is attached, with a common rail arranged around the cylinder head as well as the present invention, on the assumption that a direction where a crank shaft spans is taken as a front and rear direction and that a widthwise direction of the cylinder head perpendicular to the front and rear direction is deemed as a lateral direction.

However, in the conventional multi-cylinder engine, the common rail is not sufficiently isolated from the cylinder head, as indicated in Japanese Patent Application Laid-Open (Kokai) No. 2001-227407 (see FIGS. 1 and 3), to result in entailing problems.

The conventional technique has the following problem.

<Problem> The common rail is easily damaged.

The common rail is not so sufficiently isolated from the cylinder head that combustion heat of the engine is readily conducted to the common rail. Thus the common rail is easily damaged by overheating.

SUMMARY OF THE INVENTION

The present invention has an object to provide a multi-cylinder engine able to solve the above-mentioned problem and more specifically a multi-cylinder engine capable of inhibiting the common rail from being damaged.

The featuring matter of the invention according to a first aspect is as follows.

As illustrated in FIG. 1, a direction where a crank shaft spans is defined as a front and rear direction and a widthwise direction of a cylinder head 1 perpendicular to the front and rear direction is specified as a lateral direction. Then a multi-cylinder engine comprises the cylinder head 1 having one lateral side surface onto which an intake-air distributing passage wall 2 is attached and having the other lateral side surface onto which an exhaust-gas converging passage wall 3 is attached, with a common rail 10 arranged around the cylinder head 1, wherein as shown in FIG. 4, the common rail 10 is arranged just laterally of the intake-air distributing passage wall 2, thereby positioning the intake-air distributing passage wall 2 between the cylinder head 1 and the common rail 10.

(Effect of the Invention)

(The invention of the First Aspect)

<Effect> It is possible to prohibit the common rail from being damaged.

As illustrated in FIGS. 1 and 4, the common rail 10 is arranged just laterally of the intake-air distributing passage wall 2, thereby positioning the intake-air distributing passage wall 2 between the cylinder head 1 and the common rail 10. Thus the intake-air distributing passage wall 2 isolates the common rail 10 from the cylinder head 1 with the result of hardly conducting the combustion heat of the engine to the common rail 10. This prevents the overheating of the common rail 10 and therefore inhibits the common rail 10 from being damaged by the overheating.

(The invention of a second aspect)

<Effect> It is possible to inhibit the common rail from being damaged.

It offers the following effect in addition to that of the invention according to the first aspect.

As shown in FIGS. 1 and 4, an intake-air inlet pipe 11 is made to stand up at an upper portion of the intake-air distributing passage wall 2 and is provided with an intake-air flange portion 12. This intake-air flange portion 12 is positioned just above the common rail 10. In consequence, at the time of manufacturing the engine or effecting the maintenance, even if parts, tools or the like substances fall in an upper area of the engine, the intake-air flange portion 12 can receive those substances before they collide against the common rail 10 immediately from above. This results in the possibility of inhibiting the common rail 10 from being damaged by the collision of the substances thereagainst just from above.

(Invention of a third aspect)

It offers the following effect in addition to that of the invention according to the first aspect or the second aspect.

<Effect> It is possible to inhibit the common rail from being damaged.

As shown in FIGS. 1 and 4, an EGR-gas inlet pipe 13 is made to stand up at the upper portion of the intake-air distributing passage wall 2 and has an upper portion provided with a gas flange portion 14. This gas flange portion 14 is positioned just above the common rail 10. In consequence, at the time of manufacturing the engine or effecting the maintenance, even if parts, tools or the like substances fall in the upper area of the engine, the gas flange portion 14 can receive those substances before they collide against the common rail 10 immediately from above. This results in the possibility of inhibiting the common rail 10 from being damaged by the collision of the substances thereagainst just from above.

(Invention of a fourth aspect)

It offers the following effect in addition to that of the invention according to the third aspect.

<Effect> It is possible to prohibit an EGR valve from being damaged.

As illustrated in FIGS. 1, 3 and 4, the gas flange portion 14 is positioned at the back of an engine cooling fan 6 and an EGR valve case 8 is attached to the gas flange portion 14, so that engine cooling air produced by the engine cooling fan 6 blows against the gas flange portion 14. Therefore, the heat of the EGR gas is diffused from the EGR valve case 8 into the engine cooling air through the gas flange portion 14 to result in lowering the temperature of the EGR gas. This inhibits the overheating of the EGR valve with the result of being able to prohibit the EGR valve from being damaged by the overheating.

<Effect> It can highly reduce Nox.

The heat of the EGR gas is diffused from the EGR valve case 8 into the engine cooling air through the gas flange portion 14 to lower the temperature of the EGR gas. This enables Nox to be highly reduced.

<Effect> Maintenance can be made easily.

As illustrated in FIGS. 1, 3 and 4, the gas flange portion 14 is positioned just above the common rail 10 and the EGR valve case 8 is attached to the gas flange portion 14. Accordingly, the maintenance can be performed for the common rail 10 and the EGR valve case 8 all together on the same lateral side of the engine and therefore can be effected easily.

<Invention of a fifth aspect>

It offers the following effect in addition to that of the invention according to the fourth aspect.

<Effect> It can more enhance the ability of inhibiting the EGR valve from being damaged.

As illustrated in FIGS. 3 and 4, the gas flange portion 14 has an under surface inclined rearwards downwardly, thereby enabling the engine cooling air to blow against the gas flange portion 14 efficiently with the result of inhibiting the overheating of the EGR valve. Thus it is possible to more enhance the ability of prohibiting the EGR valve from being damaged by the overheating.

<Effect> It is possible to more enhance the ability of reducing Nox.

As illustrated in FIGS. 3 and 4, the gas flange portion 14 has the under surface inclined rearwards downwardly, thereby allowing the engine cooling air to blow against the gas flange portion 14 efficiently with the result of lowering the temperature of the EGR gas. Thus the ability of reducing Nox can be more enhanced.

<Effect> It is possible to inhibit the common rail from being damaged.

As exemplified in FIGS. 3 and 4, the engine cooling air is guided by the under surface of the gas flange portion 14 so as to blow against the common rail 10. This prohibits the overheating of the common rail 10 to entail the possibility of inhibiting the common rail 10 from being damaged by the overheating.

(Invention of a Sixth Aspect)

It offers the following effect in addition to that of the invention according to any one of the third to fifth aspects.

<Effect> It is possible to inhibit a fuel supply pump from being damaged.

As illustrated in FIGS. 1, 3 and 4, attached to the gas flange portion 14 is the EGR valve case 8, to which a valve actuator 15 is attached. This valve actuator 15 is positioned just above a fuel supply pump 16. Therefore, at the time of manufacturing the engine or performing the maintenance, even if parts, tools or the like substances fall, the valve actuator 15 can receive those substances before they collide against the fuel supply pump 16. Thus it is possible to inhibit the fuel supply pump 16 from being damaged by the collision of the substances thereagainst immediately from above.

<Effect> Maintenance can be effected easily.

As exemplified in FIGS. 1, 3 and 4, the gas flange portion 14 is positioned just above the common rail 10. Attached to the gas flange portion 14 is the EGR valve case 8, to which the valve actuator 15 is attached. Further, the valve actuator 15 is arranged just above the fuel supply pump 16. Thus maintenance can be performed for the common rail 10, the EGR valve case 8, the valve actuator 15 and the fuel supply pump 16 all together on the same lateral side of the engine and therefore can be effected easily.

(Invention of a Seventh Aspect)

It offers the following effect in addition to that of the invention according to any one of the first to sixth aspects.

<Effect> It is possible to inhibit the common rail from being damaged.

As exemplified in FIGS. 3 and 4, a cooling water pump 17 is attached to a front portion of the engine and has an inlet pipe portion 18 positioned just in front of the common rail 10 ahead thereof. In consequence, at the time of producing the engine or effecting the maintenance, even if parts, tools or the like substances approach from the just front portion of the common rail 10 ahead thereof, the inlet pipe portion 18 of the cooling water pump 17 can receive those substances before they collide against the common rail 10 from the just front portion of the common rail 10 ahead thereof. Thus it is possible to prevent the common rail 10 from being damaged by the collision of the substances thereagainst just from the front portion of the common rail 10 ahead thereof.

(Invention of an Eighth Aspect)

It offers the following effect in addition to that of the invention according to any one of the first to seventh aspects.

<Effect> It is possible to inhibit the common rail from being damaged.

As shown in FIGS. 3 and 4, a fuel filter 19 is arranged just laterally of the cylinder head 1 and positioned immediately at the back of the common rail 10. Thus at the time of producing the engine or effecting the maintenance, even if parts, tools or the like substances approach just from the back of the common rail 10, the fuel filter 19 can receive those substances before they collide against the common rail 10 just from the back of the latter. Therefore, it is possible to inhibit the common rail 10 from being damaged by the collision of the substances thereagainst just from the back of the common rail 10.

<Effect> Maintenance can be facilitated.

As exemplified in FIGS. 3 and 4, the fuel filter 19 is disposed immediately at the back of the common rail 10. Thus the maintenance can be performed for the common rail 10 and the fuel filter 19 all together on the same lateral side of the engine and therefore can be effected easily.

(Invention of a Ninth Aspect)

It offers the following effect in addition to that of the invention according to any one of the first to eighth aspects.

<Effect> It is possible to inhibit the common rail from being damaged.

As exemplified in FIGS. 1, 3 and 4, a cylinder block 5 has a lateral wall provided with a seat 20 for attaching an oil filter 21. The oil filter 21 is attached to this oil-filter attaching seat 20, which is positioned just below the common rail 10. Thus at the time of manufacturing the engine and performing the maintenance, even if parts, tools or the like substances approach the common rail 10 just from below, the oil-filter attaching seat 20 can receive those substances before they collide against the common rail 10 just from below. Therefore, it is possible to inhibit the common rail 10 from being damaged by the collision of the substances thereagainst just from below the common rail 10.

<Effect> Maintenance can be facilitated.

Since the oil-filter attaching seat 20 is positioned just below the common rail 10, maintenance can be performed for the common rail 10 and the oil filter 21 all together on the same lateral side of the engine and therefore can be effected easily.

(Invention of a Tenth Aspect)

It offers the following effect in addition to that of the invention according to any one of the first to ninth aspects.

<Effect> It is possible to make an EGR cooler compact.

As shown in FIGS. 1 to 3, an EGR gas lead-out pipe 7 conducted out of an EGR cooler 4 is arranged rearwards of the engine cooling fan 6 in order that the engine cooling air produced by the engine cooling fan 6 might blow against the EGR gas lead-out pipe 7. Therefore, it is possible to alleviate the cooling load of the EGR cooler 4 in proportion to the EGR gas to be air-cooled by the EGR gas lead-out pipe 7. This invites the possibility of making the EGR cooler 4 compact.

(The invention of an Eleventh Aspect)

It offers the following effect in addition to that of the invention according to the tenth aspect.

<Effect> It is possible to inhibit an EGR valve from being damaged.

As shown in FIGS. 1 to 3, an EGR valve case 8 is arranged downstream of the EGR gas lead-out pipe 7. Thus the EGR gas is cooled by the EGR cooler 4 and is air-cooled by the EGR gas lead-out pipe 7 and then reaches the EGR valve case 8. This prohibits the overheating of the EGR valve with the result of inhibiting the EGR valve from being damaged by the overheating.

(Invention of a Twelfth Aspect)

It offers the following effect in addition to that of the invention according to the tenth or eleventh aspect.

<Effect> It is possible to make a radiator compact.

As exemplified in FIGS. 1 to 3, a cooling water lead-out pipe 9, which is conducted out of an EGR cooler 4, is disposed at the back of the engine cooling fan 6 so that the engine cooling air generated by the engine cooling fan 6 blows against the cooling water lead-out pipe 9. Therefore, it is possible to reduce the cooling load of a radiator (not shown) in proportion to the cooling water, which has been flowed out of the EGR cooler 4, to be air-cooled by the cooling water lead-out pipe 9. This invites the possibility of making the radiator compact.

MOST PREFERRED EMBODIMENT OF THE INVENTION

An embodiment of the present invention is explained based on the attached drawings. FIGS. 1 to 4 show an engine according to the embodiment of the present invention. In this embodiment, an explanation is given for a water-cooled vertical straight multi-cylinder diesel engine.

The embodiment of the present invention is outlined as follows.

Figure 2:
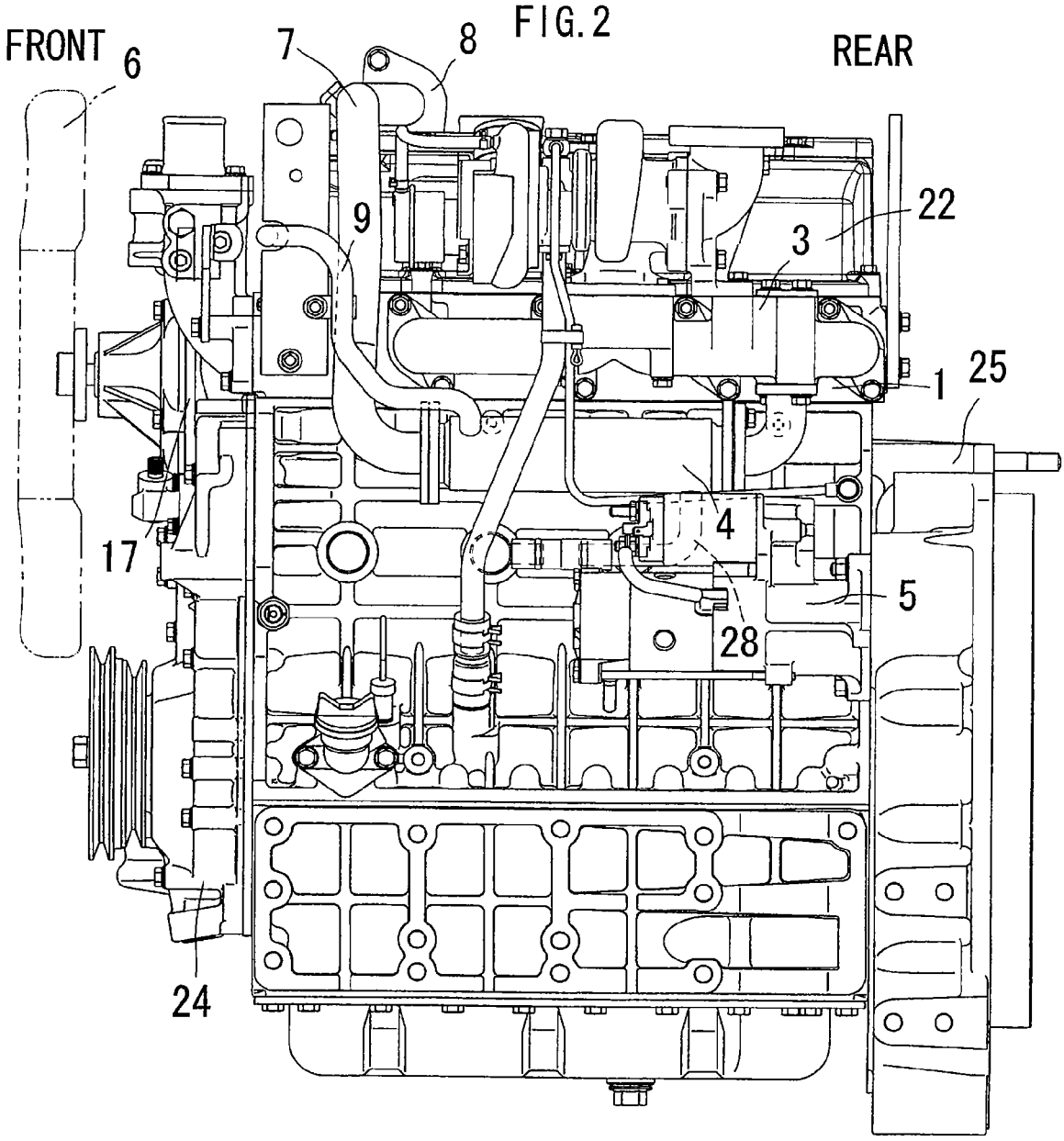
FIG. 2 is a right side view of the engine according to the embodiment of the present invention.
Figure 3:
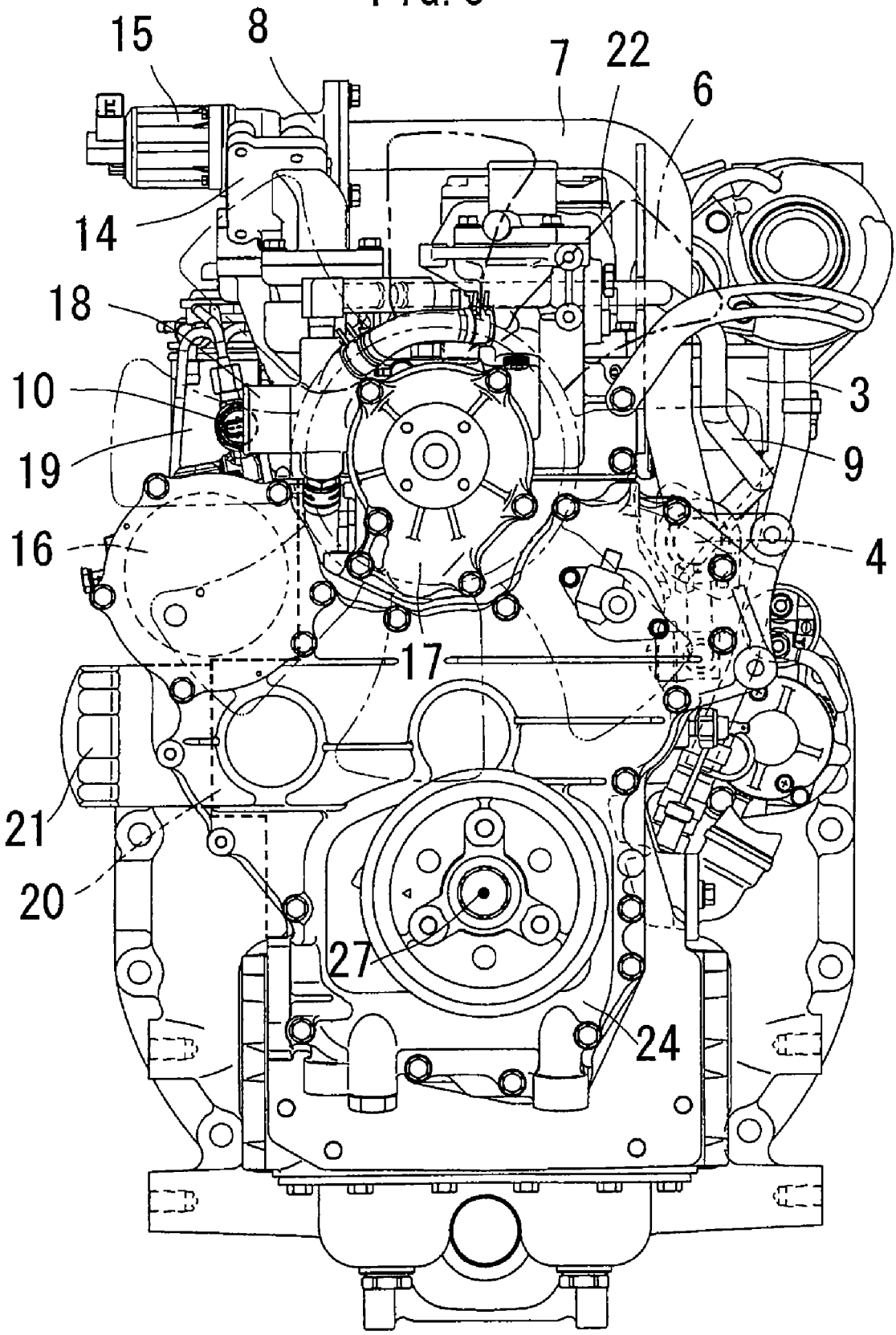
FIG. 3 is a front view of the engine according to the embodiment of the present invention.
Figure 4:
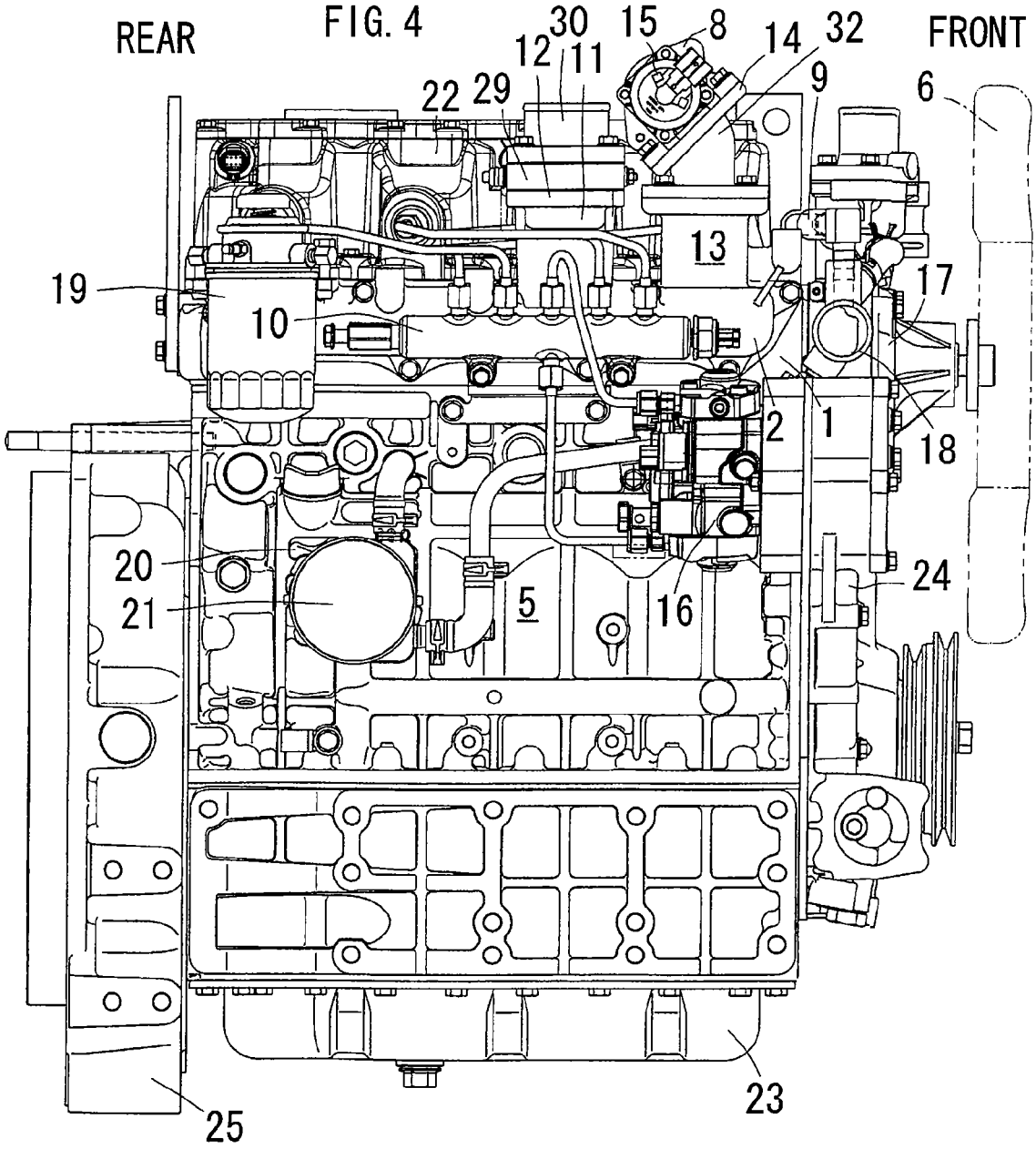
FIG. 4 is a left side view of the engine according to the embodiment of the present invention.

As shown in FIGS. 2 to 4, a cylinder head 1 is assembled to an upper portion of a cylinder block 5 and has an upper portion to which a head cover 22 is assembled. The cylinder block 5 has a lower portion to which an oil pan 23 is assembled and has a front portion to which a gear case 24 is assembled. Further, the cylinder block 5 has a rear portion to which a flywheel housing 25 is assembled.

A cooling water pump 17 is attached to the cylinder block 5 above the gear case 24. The cooling water pump 17 has an input shaft to which an engine cooling fan 6 is attached. The cooling water pump 17 and the engine cooling fan 6 are driven by a crank shaft through a belt transmission device (not shown). A radiator (not shown) is arranged ahead of the engine cooling fan 6. When the engine cooling fan 6 is rotated, cooling air is sucked from a front portion of the radiator thereinto and is outputted as cooling exhaust-gas which comes to be engine cooling air.

This engine is equipped with an EGR device and with a fuel injection device of common-rail type. The EGR device reduces part of the exhaust-gas into intake air. The fuel injection device of common-rail type accumulates the fuel having its pressure increased by a fuel supply pump 16 in its common rail 10. An injector has an electromagnetic valve to be opened and closed through electronic control so as to adjust the amount of the fuel to be injected at the time of fuel injection of every cylinder.

The EGR device is devised as follows.

Figure 1:
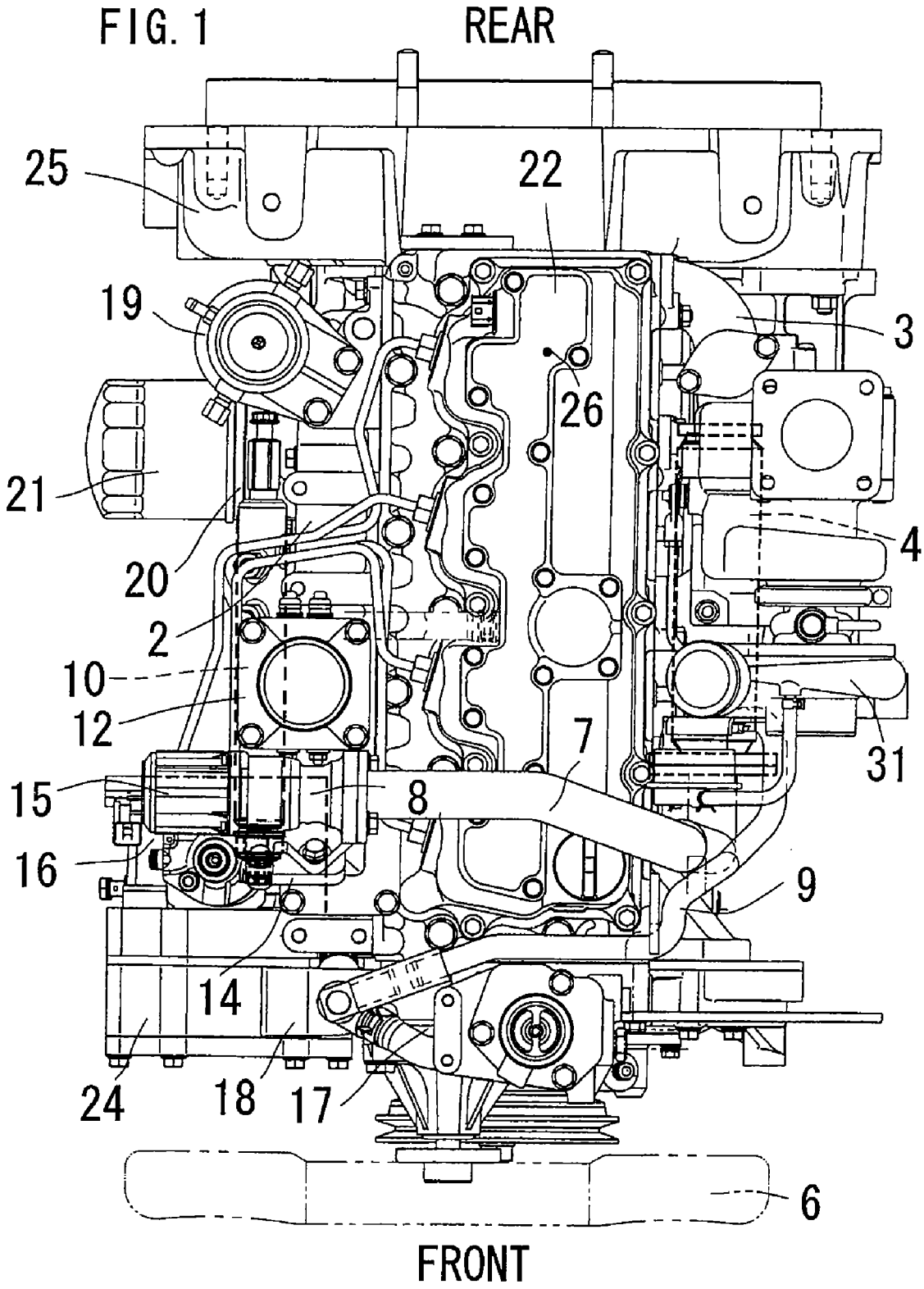
FIG. 1 is a plan view of an engine according to an embodiment of the present invention.

As shown in FIG. 1, a direction where the crank shaft spans is a front and rear direction and a widthwise direction of the cylinder head 1 perpendicular to this front and direction is a lateral direction. The cylinder head 1 has a left side surface to which an intake-air distributing passage wall 2 is attached and has a right side surface to which an exhaust-gas converging passage wall 3 is attached. An EGR cooler 4 is interposed between an exhaust-gas converging passage and an intake-air distributing passage. The intake-air distributing passage wall 2 is an intake air manifold and the exhaust-gas converging passage wall 3 is an exhaust-gas manifold.

As exemplified in FIGS. 1 to 3, the EGR cooler 4 spans in the front and rear direction laterally of the cylinder block 5 and the exhaust-gas converging passage wall 3 is positioned just above this EGR cooler 4. The position just above the EGR cooler 4 refers to a position which is above the EGR cooler 4 and overlaps the same, as shown in FIG. 1, when seen in a direction parallel to a cylinder center axis 26. Further, if seen in the direction parallel to the cylinder center axis 26, the EGR cooler 4 is arranged so as not to project laterally of the exhaust-gas converging passage wall 3.

As shown in FIGS. 1 to 3, one side where the engine cooling fan 6 is present is defined as the front and the opposite side is determined as the rear. An EGR gas lead-out pipe 7 conducted out of the EGR cooler 4 is arranged rearwards of the engine cooling fan 6 in order that the engine cooling air produced by the engine cooling fan 6 might blow against the EGR gas lead-out pipe 7. An EGR valve case 8 is positioned downstream of the EGR gas lead-out pipe 7. A cooling water lead-out pipe 9 conducted out of the EGR cooler 4 is disposed rearwards of the engine cooling fan 6 so that the engine cooling air generated by the engine cooling fan 6 might blow against the cooling water lead-out pipe 9. Either of the EGR gas lead-out pipe 7 and the cooling water lead-out pipe 9 is arranged immediately rearwards of the engine cooling fan 6.

The position immediately rearwards of the engine cooling fan 6, as sown in FIG. 3, refers to a position which is at the back of the engine cooling fan and overlaps the same when seen in a direction parallel to a center axis 27 of the crank shaft. As illustrated in FIG. 3, the cooling water lead-out pipe 9 has a lead-out end made to communicate with a sucking side of the cooling water pump 17. As shown in FIG. 2, a cooling water lead-in pipe 28 conducted out of the EGR cooler 4 has a lead-out end made to communicate with a cylinder jacket (not shown) within the cylinder bock 5.

The fuel injection device of common-rail type is devised as follows.

As represented in FIGS. 1 and 4, the common rail 10 is arranged just laterally of the intake-air distributing passage wall 2, thereby positioning the intake-air distributing passage wall 2 between the cylinder head 1 and the common rail 10. The position just lateral of the intake-air distributing passage wall 2 refers to, as shown in FIG. 4, a position which is opposite to the cylinder head 1 and overlaps the intake-air distributing passage wall 2 when seen in a direction perpendicular to the cylinder center axis 26 and to the center axis 27 of the crank shaft. An intake-air inlet pipe is made to stand up at an upper portion of the intake-air distributing passage wall 2 and is provided with an intake-air flange portion 12. This intake-air flange portion 12 is positioned just above the common rail 10. The position just above the common rail 10 refers to a position which is above the common rail and overlaps the same as shown in FIG. 1 when seen in the direction parallel to the cylinder center axis 26. An intake-air connection pipe 30 is attached to the intake-air flange portion 12 through an intake air heater 29. Connected to this intake-air connection pipe 30 is a lead-out end of an intake air pipe (not shown) conducted out of a supercharger 31.

As shown in FIGS. 1 and 4, an EGR-gas inlet pipe 13 is made to stand up at the upper portion of the intake-air distributing passage wall 2. A gas flange portion 14 is provided above the EGR gas inlet pipe 13 and is positioned just above the common rail 10. Attached to the EGR gas inlet pipe 13 is an EGR gas connection pipe 32. This EGR gas connection pipe 32 has an upper end portion to which the gas flange portion 14 is attached.

As shown in FIGS. 1, 3 and 4, the gas flange portion 14 is positioned at the back of the engine cooling fan 6. The EGR valve case 8 is attached to this gas flange portion 14 so that the engine cooling air generated by the engine cooling fan 6 might blow against the gas flange portion 14. The gas flange portion 14 has an under surface inclined rearwards downwardly in order that the engine cooling air might be guided by the under surface of the gas flange portion 14 to blow against the common rail 10. The EGR valve case 8 is attached to the gas flange portion 14 and a valve actuator 15 is attached to the EGR valve case 8. The valve actuator 15 is positioned just above a fuel supply pump 16. The position just above the fuel supply pump 16 refers to a position which is above the fuel supply pump 16 and overlaps the same, when seen in the direction parallel to the cylinder center axis 26.

As represented in FIGS. 1, 3 and 4, the cooling water pump 17 is attached to the front portion of the engine and has an inlet pipe portion 18 positioned in the just front of the common rail 10 ahead thereof. The inlet pipe portion 18 is connected to a lead-out end of a cooling water return pipe (not shown) conducted out of the radiator. The position in the just front of the common rail 10 ahead thereof refers to a position which is in front of the common rail 10 and overlaps the same as shown in FIG. 3 when seen in a direction parallel to the center axis 27 of the crank shaft.

As illustrated in FIGS. 1, 3 and 4, a fuel filter 19 is arranged immediately lateral of the cylinder head 1 and is positioned immediately rearwards of the common rail 10. The cylinder block 5 has a lateral wall provided with a seat 20 for attaching an oil filter 21. The oil filter 21 is attached to the oil-filter attaching seat 20, which is positioned just below the common rail 10. The position immediately rearwards of the common rail 10 refers to a position which is at the back of the common rail 10 and overlaps the same, as shown in FIG. 3 when seen in the direction parallel to the center axis 27 of the crank shaft. The position just below the common rail 10 refers to a position which is below the common rail 10 and overlaps the same as shown in FIG. 1 when seen in the direction parallel to the cylinder center axis 26.

What is claimed is:

1. A vertical straight multi-cylinder engine wherein a direction in which a crank shaft spans is a front and rear direction and a widthwise direction of a cylinder head perpendicular to the front and rear direction is a lateral direction, the vertical straight multi-cylinder engine comprising:

a cylinder head which has one lateral side surface to which an intake-air distributing passage wall is attached and has the other lateral side surface to which an exhaust-gas converging passage wall is attached, a common rail being arranged around the cylinder head, and wherein the intake-air distributing passage wall is positioned between the cylinder head and the common rail by arranging the common rail laterally of the intake-air distributing passage wall at a position where the common rail overlaps the intake-air distributing passage wall when seen in a direction perpendicular to a cylinder center axis and a center axis of the crank shaft, and which is a position on a side opposite to the cylinder-head side of both lateral sides of the intake-air distributing passage wall.

2. The vertical straight multi-cylinder engine as set forth in claim 1, wherein an intake-air inlet pipe is made to stand up at an upper portion of the intake-air distributing passage wall and is provided with an intake-air flange portion, and the intake-air flange portion is positioned above the common rail at a position where the intake-air flange portion overlaps the common rail when seen in a direction parallel to the cylinder center axis.

3. The vertical straight multi-cylinder engine as set forth in claim 1, wherein an EGR-gas inlet pipe is made to stand up at an upper portion of the intake-air distributing passage wall and a gas flange portion is provided above the EGR-gas inlet pipe, the gas flange portion positioned above the common rail at a position where the gas flange portion overlaps the common rail when seen in a direction parallel to the cylinder center axis.

4. The vertical straight multi-cylinder engine as set forth in claim 3, wherein one side on which an engine cooling fan is present is defined as the front and the opposite side is determined as the rear, and wherein the gas flange portion is positioned rearwardly of the engine cooling fan and an EGR valve case is attached to the gas flange portion so that engine cooling air produced by the engine cooling fan blows against the gas flange portion.

5. The vertical straight multi-cylinder engine as set forth in claim 4, wherein the gas flange portion has an under surface inclined rearwardly and downwardly so that the engine cooling air is guided by the under surface of the gas flange portion to blow against the common rail.

6. The vertical straight multi-cylinder engine as set forth claim 3, wherein an EGR valve case is attached to the gas flange portion and a valve actuator is attached to the EGR valve case, the valve actuator being positioned above a fuel supply pump at a position where the valve actuator overlaps the fuel supply pump when seen in a direction parallel to the cylinder center axis.

7. The vertical straight multi-cylinder engine as set forth in claim 1, wherein one side on which the engine cooling fan is present is defined as the front and the opposite side is determined as the rear, and wherein a cooling water pump is attached to a front portion of the engine and has an inlet pipe portion positioned in front of the common rail at a position where the inlet pipe portion overlaps the common rail when seen in a direction parallel to the center axis of the crank shaft.

8. The vertical straight multi-cylinder engine as set forth in claim 1, wherein a fuel filter is arranged laterally of the cylinder head at a position where the fuel filter overlaps the cylinder head when seen in a direction perpendicular to the cylinder center axis and the center axis of the crank shaft, and is positioned rearwardly of the common rail at a position where the fuel filter overlaps the common rail when seen in a direction parallel to the center axis of the crank shaft.

9. The vertical straight multi-cylinder engine as set forth in claim 1, wherein a cylinder block has a lateral wall provided with a seat for attaching an oil filter, to which the oil filter is attached, and the oil-filter attaching seat is positioned below the common rail at a position where the oil-filter attaching seat overlaps the common rail when seen in the direction parallel to the cylinder center axis.

10. The vertical straight multi-cylinder engine as set forth in claim 1, wherein an EGR cooler is interposed between an exhaust-gas converging passage and an intake-air distributing passage, and wherein one side on which an engine cooling fan exists is defined as the front and the opposite side is determined as the rear, and an EGR gas lead-out pipe conducted out of the EGR cooler is arranged rearwardly of the engine cooling fan in order that the engine cooling air produced by the engine cooling fan blows against the EGR lead-out pipe.

11. The vertical straight multi-cylinder engine as set forth in claim 10, wherein an EGR valve case is arranged downstream of the EGR gas lead-out pipe.

12. The vertical straight multi-cylinder engine as set forth in claim 10, wherein one side on which the engine cooling fan exists is defined as the front and the opposite side is determined as the rear, and wherein a cooling water lead-out pipe conducted out of the EGR cooler is arranged rearwardly of the engine cooling fan in order that the engine cooling air produced by the engine cooling fan blows against the cooling water lead-out pipe.

* * * * *